US010172437B2

(12) United States Patent
Barber

(10) Patent No.: US 10,172,437 B2
(45) Date of Patent: Jan. 8, 2019

(54) DUAL ACCESS-POINT SYSTEM FOR HOLDING AN ITEM

(71) Applicant: Roam Without Being Ltd., Christchurch (NZ)

(72) Inventor: Douglas G. C. Barber, Christchurch (NZ)

(73) Assignee: Roam Without Being Ltd. (NZ)

( * ) Notice: Subject to any disclaimer, the term of this patent is extended or adjusted under 35 U.S.C. 154(b) by 0 days.

(21) Appl. No.: 15/337,273

(22) Filed: Oct. 28, 2016

(65) Prior Publication Data

US 2017/0119131 A1 May 4, 2017

Related U.S. Application Data

(60) Provisional application No. 62/248,939, filed on Oct. 30, 2015.

(51) Int. Cl.

| | |
|---|---|
| ***A45F 3/04*** | (2006.01) |
| *A45C 7/00* | (2006.01) |
| *A45C 13/02* | (2006.01) |

(52) U.S. Cl.

CPC ..... *A45F 3/04* (2013.01); *A45C 7/0095* (2013.01); *A45C 13/02* (2013.01); *A45F 3/047* (2013.01)

(58) Field of Classification Search

CPC ..... A45F 2004/023; A45C 7/00; A45C 7/005; A45C 7/009

USPC ..... 224/578–583

See application file for complete search history.

(56) References Cited

U.S. PATENT DOCUMENTS

| | | | | | |
|---|---|---|---|---|---|
| 4,883,207 | A * | 11/1989 | McArthur | A45F 3/04 | 190/113 |
| 4,887,751 | A * | 12/1989 | Lehman | A45C 5/14 | 190/1 |
| 5,209,384 | A * | 5/1993 | Anderson | A45C 13/02 | 224/223 |
| 5,544,792 | A * | 8/1996 | Arnwine | A45C 7/0086 | 224/153 |
| 5,797,529 | A * | 8/1998 | Lavine | A45C 7/0077 | 190/103 |
| 5,799,851 | A * | 9/1998 | Wulf | A45C 7/0045 | 224/580 |
| 5,887,770 | A * | 3/1999 | Covell | A45C 13/30 | 150/102 |
| 5,964,384 | A * | 10/1999 | Young | A45C 7/0063 | 190/103 |
| 6,015,072 | A * | 1/2000 | Young | A45C 7/0063 | 190/103 |
| 6,659,320 | B1 * | 12/2003 | Alves | A45C 7/0086 | 224/581 |

(Continued)

*Primary Examiner* — Brian D Nash

(74) *Attorney, Agent, or Firm* — Bekiares Eliezer LLP

(57) ABSTRACT

Disclosed is a dual access-point system for holding an item. The dual access-point system allows a traveler to easily store and retrieve one or more items through two sides of a backpack (e.g., via the top and the side). Additionally, the backpack can be quickly converted into a suitcase; for example, by hiding the straps in the pockets on the backpack. The dual access-point system may be used as a standalone system. Alternatively, the dual access-point system may be integrated with a backpack. The disclosed dual access-point system saves time and money for its users, making their lives easier while making them look good and professional.

15 Claims, 11 Drawing Sheets

(56) References Cited

U.S. PATENT DOCUMENTS

| | | | | |
|---|---|---|---|---|
| 7,600,619 | B2 * | 10/2009 | Sapyta | A45C 7/0054 190/107 |
| 8,567,652 | B2 * | 10/2013 | Di Stasio | A45F 3/047 224/578 |
| 2007/0058887 | A1 * | 3/2007 | Godshaw | A45C 13/00 383/104 |
| 2007/0125815 | A1 * | 6/2007 | Tong | A45C 5/14 224/153 |
| 2007/0145089 | A1 * | 6/2007 | Robert | A01M 31/025 224/637 |
| 2007/0175941 | A1 * | 8/2007 | Berry | A45C 7/0077 224/583 |
| 2007/0235490 | A1 * | 10/2007 | Katz | A45C 15/00 224/579 |
| 2008/0029562 | A1 * | 2/2008 | Hawkins | A45F 3/04 224/153 |
| 2010/0282809 | A1 * | 11/2010 | Scicluna | A45C 7/0095 224/653 |
| 2011/0186611 | A1 * | 8/2011 | Eberle | A45F 4/00 224/583 |
| 2014/0069063 | A1 * | 3/2014 | Edmonds | A45C 3/00 53/473 |
| 2015/0129627 | A1 * | 5/2015 | Roberts | A45F 3/04 224/581 |
| 2015/0208790 | A1 * | 7/2015 | Pylkovas | A45F 3/02 224/578 |

* cited by examiner

DUAL ACCESS-POINT SYSTEM FOR HOLDING AN ITEM

RELATED APPLICATION

Under provisions of 35 U.S.C. § 119(e), the Applicant claims the benefit of U.S. provisional application No. 62/248,939, filed Oct. 30, 2015, in the name of DOUGLAS BARBER, who is the named as DOUGLAS G. C. BARBER on the present application, which is incorporated herein by reference.

It is intended that each of the referenced applications may be applicable to the concepts and embodiments disclosed herein, even if such concepts and embodiments are disclosed in the referenced applications with different limitations and configurations and described using different examples and terminology.

FIELD OF THE INVENTION

This invention generally relates to a luggage system. More specifically, the invention relates to a luggage system to easily and securely store and carry one or more items.

BACKGROUND

Various types of luggage systems are widely used by travelers across the world. The wheeled suitcases and other rolling luggage systems are the most popular with the travelers. However, many airlines have tightened their luggage requirements and security measures have become increasingly strict. Therefore, the travelers are often forced to waste time to check-in the luggage and then wait for the luggage to show up on the conveyor belt at airports. Further, it is difficult to roll these suitcases upstairs and across rough surfaces like cobblestones or broken streets.

Travelers may prefer to use backpacks while traveling. Backpacks have been widely used across the world for a number of years. They are designed to carry school-books, clothing, hiking equipment, sports equipment and electronic equipment. However, backpacks do not provide a professional look to the traveler. Further, backpacks have only one opening at the top. Therefore, the travelers have to dig into the bag from the top to retrieve any item stored therein.

Further, the travelers store electronic devices like laptops and tablets in their backpacks. However, these backpacks may not be designed to securely and easily store these electronic devices. Again, the travelers need to store and retrieve the electronic devices from the single opening at the top of the backpack. In addition, some backpacks need to be checked-in at airports.

Therefore, there is a need for a luggage system that allows travelers to easily store and retrieve one or more items. Further, there is also a need for a luggage system that can be easily carried by the travelers (such as at airports).

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

Disclosed is a dual access-point system for holding an item. The dual access-point system may be used as a standalone system. Alternatively, the dual access-point system may be integrated with a backpack.

Further, the dual access-point system allows a traveler to easily store and retrieve one or more items through two sides of the backpack (via the top and one of the sides).

Additionally, the backpack can be quickly converted into a suitcase; for example, by hiding the straps in pockets on the backpack.

Moreover, the disclosed dual access-point system saves time and money of the travelers. Further, the system makes travelers' life easier and helps them look good and professional.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
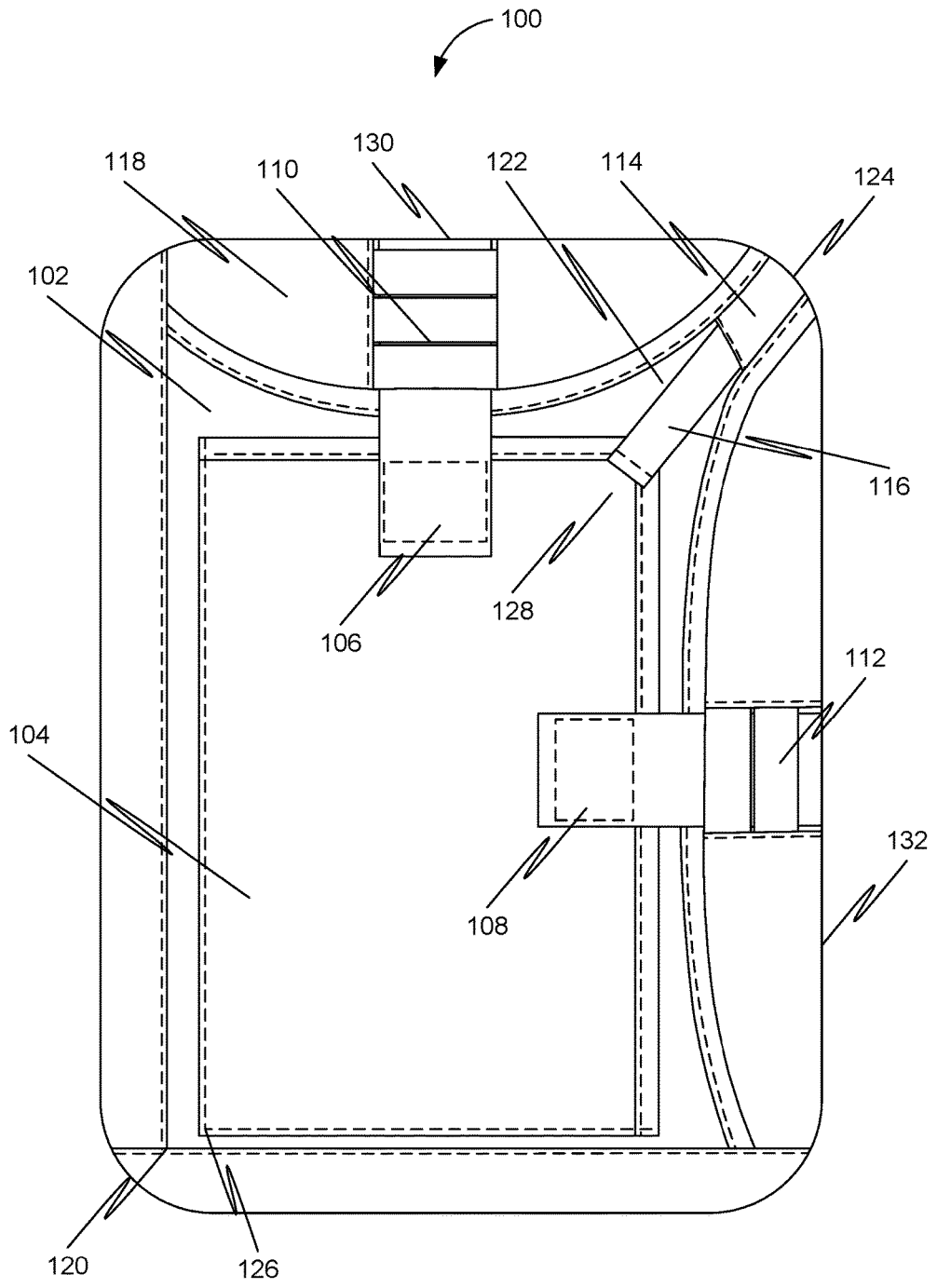
FIG. 1 illustrates a front view of a dual-access point system, according to some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of a dual access-point system for holding an item, embodiments of the present disclosure are not limited to use only in this context.

According to some embodiments, the present disclosure relates to a dual access-point system for holding an item securely inside a bag.

FIG. 1 illustrates a front view of a dual access-point system 100 for holding an item securely inside a bag. As shown, the dual access-point system 100 includes a first sleeve 102, a second sleeve 104, a top fastener 106, a side fastener 108, a top ladder formation 110, a side ladder formation 112, a first sleeve connector 114 and a second sleeve connector 116.

The dual access-point system 100 may also include a back cover 118. The back cover 118 may be one of the interior walls of a host bag 300 (shown in FIGS. 3-4), when the dual access-point system 100 is integrated within the bag 300. In some embodiments, a detachable mechanism may be used to connect back cover 118 with the host bag 300. The first sleeve 102 may be attached to the back cover 118 on two sides meeting on a corner 120. For example, the first sleeve 102 may be sewn to the back cover 118 on two sides meeting on the corner 120. Alternatively, the first sleeve 102 may be attached to the back cover 118 using an adhesive on two sides meeting on the corner 120. Yet further, the first sleeve connector 114 attaches an opposite corner 122 of the first sleeve 102 to the corner 124 of the back cover 118. For example, the first sleeve connector 114 may be a strap with two ends, such that each end of the first sleeve connector 114 may be sewn to the opposite corner 122 of the first sleeve 102 and the corner 124 of the back cover 118 respectively.

Similarly, the second sleeve 104 may be attached to the first sleeve 102 on two sides meeting on a corner 126. For example, the second sleeve 104 may be sewn to the first sleeve 102 on two sides meeting on the corner 126. Alternatively, the second sleeve 104 may be attached to the first sleeve 102 using an adhesive on two sides meeting on the corner 126. Further, the second sleeve connector 116 attaches an opposite corner 128 of the second sleeve 104 to the corner 124 of the back cover 118. For example, the second sleeve connector 116 may be a strap with two ends, such that each end of the second sleeve connector 116 may be sewn to the opposite corner 128 of the second sleeve 104 and the corner 124 of the back cover 118 respectively.

One or more items may be securely placed in the first sleeve 102 and the second sleeve 104. The one or more items may include an electronic item such as a laptop, a tablet, a smartphone and a net book. Further, the one or more items may include a notebook and book.

In an embodiment, a bigger item may be placed in the first sleeve 102 and a smaller item may be placed in the second sleeve 104.

Further, the top fastener 106 may be a strap, such that one end of the top fastener 106 may be attached to a top edge 130 of the back cover 118. For example, the one end of the top fastener 106 may be sewn to the top edge 130. The other end of the top fastener 106 may include attachment means to temporarily attach the other end of the top fastener 106 to the second sleeve 104. The top fastener 106 may be a strap made of elastic material. Further, the top fastener 106 may be fed through the top ladder formation 110. A traveler may use the top ladder formation 110 to tighten the top fastener 106 based on the size of an item placed in one or more of the first sleeve 102 and the second sleeve 104.

Further, the side fastener 108 may be a strap, such that one end of the side fastener 108 may be attached to a side edge 132 of the back cover 118. For example, the one end of the side fastener 108 may be sewn to the side edge 132. The other end of the side fastener 108 may include attachment means to temporarily attach the other end of the side fastener 108 to the second sleeve 104. The side fastener 108 may be a strap made of elastic material. Further, the side fastener 108 may be fed through the side ladder formation 112. A traveler may use the side ladder formation 112 to tighten the side fastener 108 based on the size of an item placed in one or more of the first sleeve 102 and the second sleeve 104.

The attachment means to temporarily attach the top fastener 106 or the side fastener 108 to the second sleeve 104 may include one or more of a button, a zipper, a magnetic button, a securing pin, a snap, a clasp and Velcro.

A traveler may place an item into either the first sleeve 102 or the second sleeve 104 from the top edge or the side edge of the dual access-point system 100.

In one possible embodiment, a traveler may temporarily disengage the top fastener 106 from the second sleeve 104. Then, the traveler may place an item in one of the first sleeve 102 and the second sleeve 104. Once the item is placed in one of the first sleeve 102 and the second sleeve 104, the traveler may thread the top fastener 106 through the top ladder formation 110 based on the size of the largest item in the first sleeve 102 and the second sleeve 104. Thereafter, the traveler may temporarily engage the top fastener 106 to the second sleeve 104 to securely hold the item in place inside the dual access-point system 100.

In another exemplary embodiment, a traveler may temporarily disengage the side fastener 108 from the second sleeve 104. Then, the traveler may place an item in one of the first sleeve 102 and the second sleeve 104. Once the item is placed in one of the first sleeve 102 and the second sleeve 104, the traveler may thread the side fastener 108 through the side ladder formation 112 based on the size of the largest item in the first sleeve 102 and the second sleeve 104. Thereafter, the traveler may temporarily engage the side fastener 108 to the second sleeve 104 to securely hold the item in place inside the dual access-point system 100. Top fastener 106 and side fastener 108 may be disengaged via a detachable means (e.g., Velcro, snaps, magnetics, buttons, clasps) attached to, for example, back cover 118 and located, for example, behind the second sleeve 102.

FIG. 1 illustrates the ladder formations 110-112 threaded for a smaller 13-inch laptop.

Figure 2:
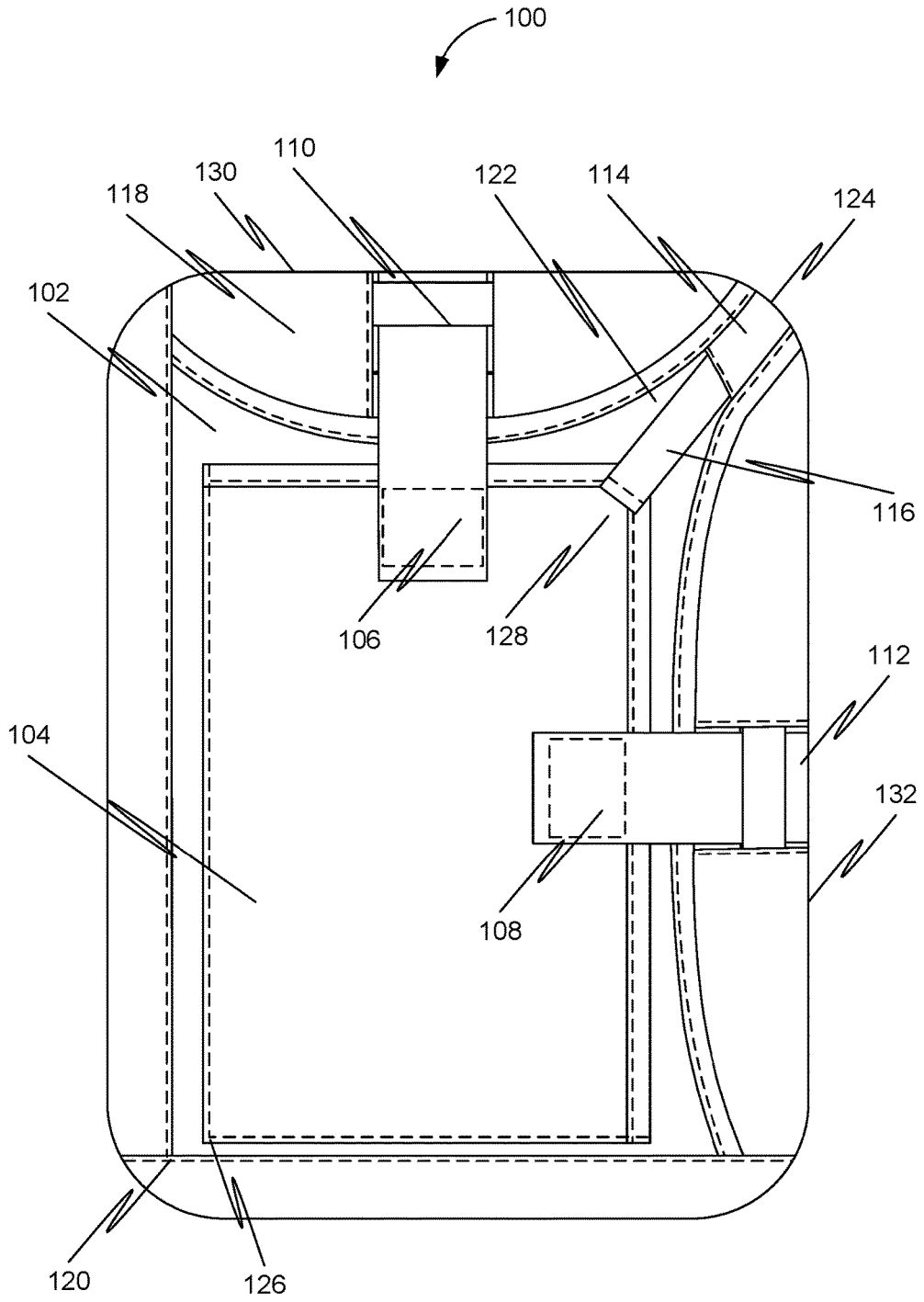
FIG. 2 illustrates a front view of the dual-access point system of FIG. 1, according to some embodiments.

FIG. 2 illustrates the ladder formations 110-112 threaded for a larger 15-inch laptop In an embodiment, one or both the top fastener 106 and the side fastener 108 may be attached to the back cover 118 from underneath the first sleeve 102 rather than the edge of the back cover 118.

In various embodiments, the dual access-point system 100 may be used as a standalone unit. Alternatively, the dual access-point system 100 may be a part of a bag 300.

In various embodiments, one or more components of the dual access-point system 100 may be attached by methods other than sewing, such as, adhesion, and nailing.

Figure 3A:
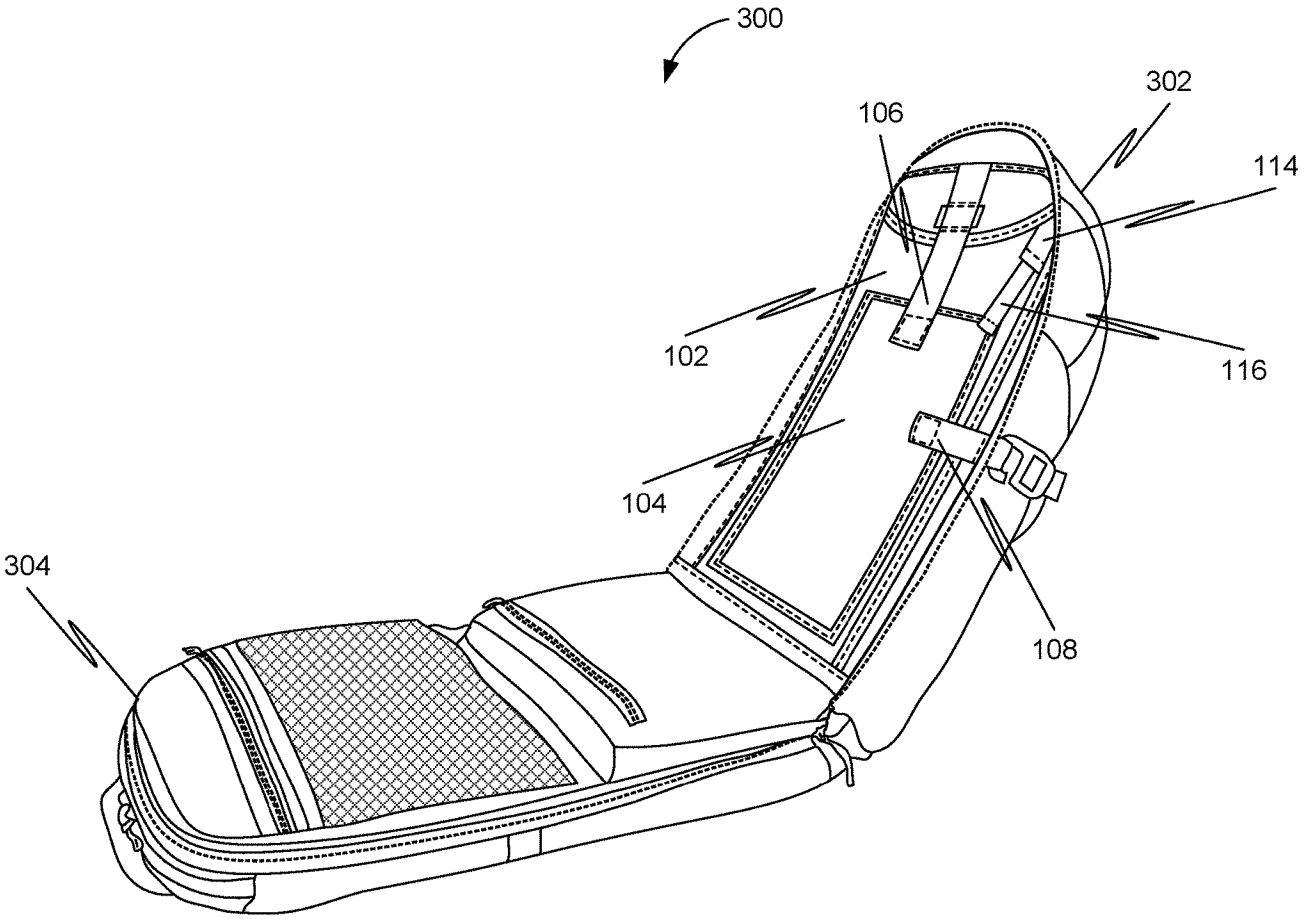
FIG. 3A illustrates the dual-access point system installed in a bag according to some embodiments.
Figure 3B:
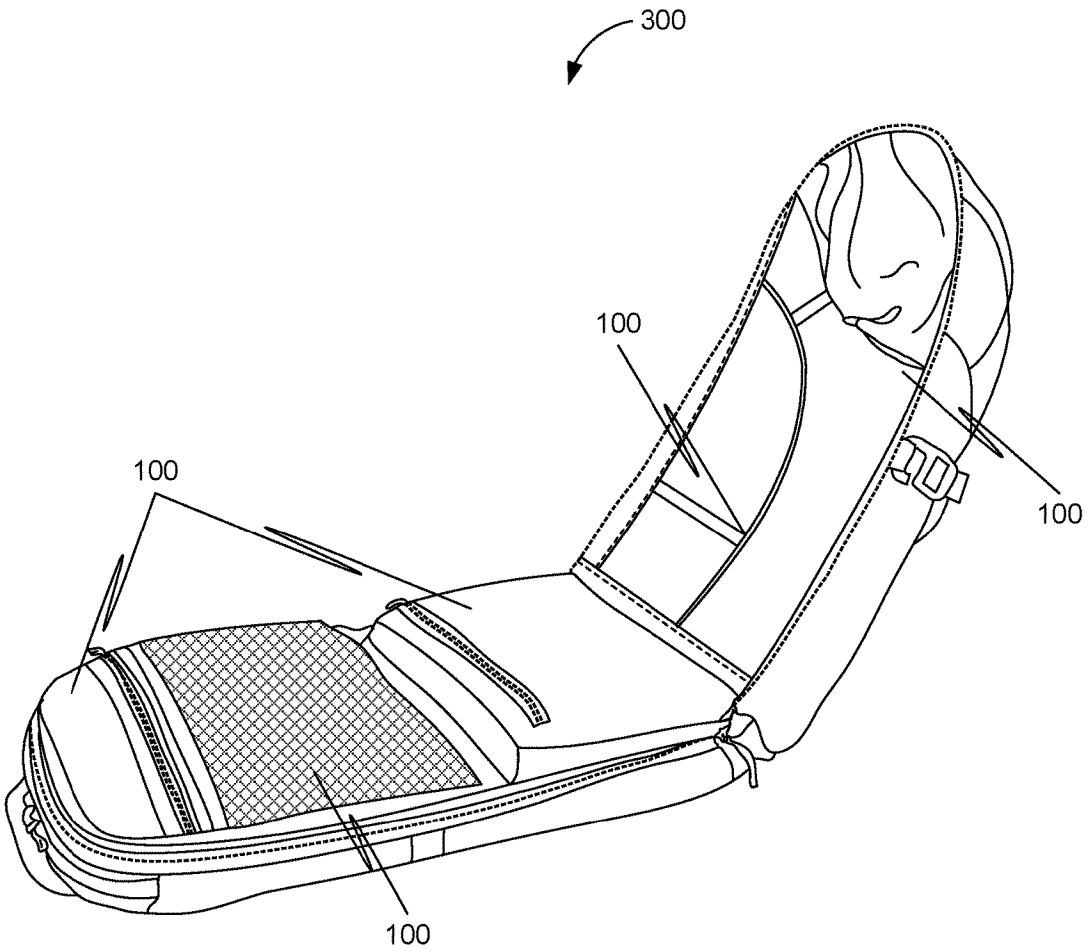
FIG. 3B illustrates another embodiment of the dual-access point system installed in a bag according to some embodiments.

In various embodiments, the bag 300 may include a zipper that goes around three sides of the bag 300. Therefore, the bag 300 may open like a suitcase as shown in FIGS. 3A-3B. In open position, the bag 300 may include two sides 302-304. As shown, the dual access-point system 100 may be integrated with the side 302. Although, FIG. 3A shows dual access-point system 100 within an internal compartment of bag 300. It should be understood that such placement is only one possible placement of dual access-point system 100. Other locations within the bag, both external and internal, are contemplated to be within the scope of dual access-point system 100's integration with bag 300.

In various embodiments, the bag 300 may include two sets of positioning straps including one or more waist straps and shoulder straps. In a further embodiment, the positioning straps may be quickly hidden in pockets arranged in the bag 300. For example, the positioning straps may be hidden in less than 10 seconds. The positioning straps may also include pullers to tighten the waist straps and shoulder straps, while carrying the bag 300. The pullers may be suitable for both the right-handed and the left-handed people.

Figure 4A:
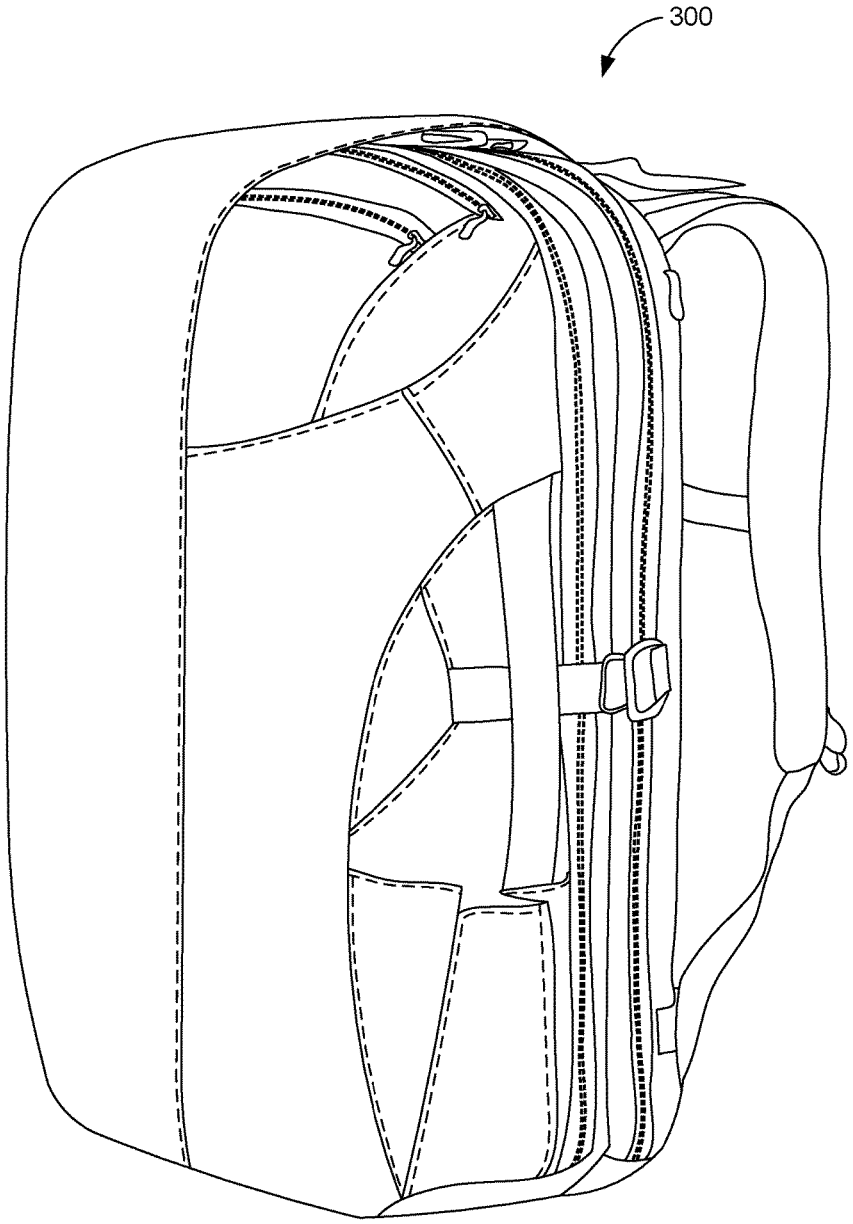
FIG. 4A illustrates the bag in closed position according to some embodiments.
Figure 4B:
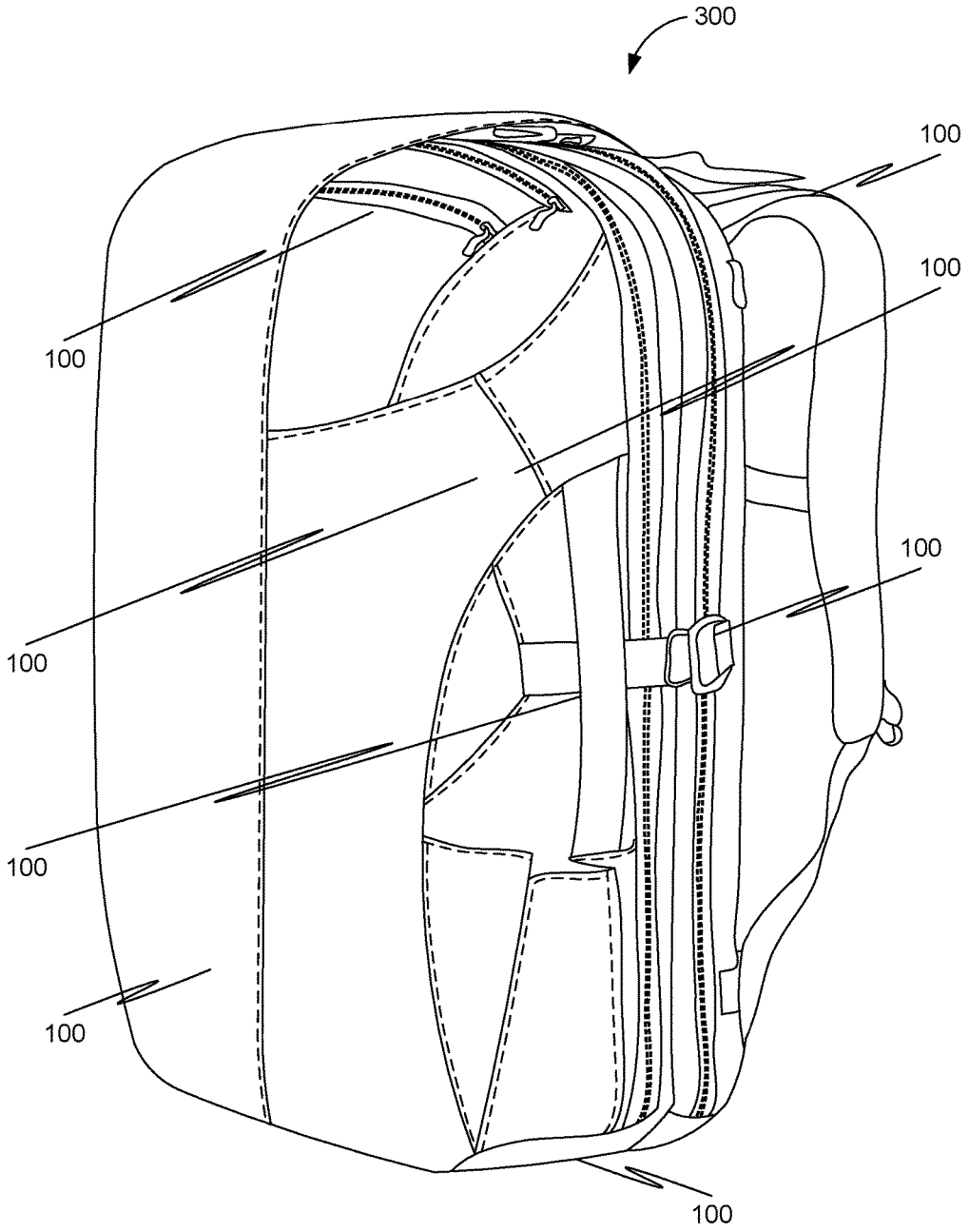
FIG. 4B illustrates another embodiment of a bag in closed position according to some embodiments.

In various embodiments, the bag 300 is a backpack that packs like a suitcase. FIGS. 4A-4B illustrate the bag 300 in closed position. The bag 300 may be quickly converted from a backpack configuration to a suitcase configuration. For example, the positioning straps may be hidden in the pockets. Further, the bag 300 may include a side handle that may be used to carry the bag 300 sideways in the suitcase configuration.

In various embodiments, the bag 300 may include a seam-sealed rain cover that is easy to pull out (of a pocket in the bag 300), then pull on the bag 300, and then pack into the pocket and may be removed permanently, if unnecessary. For example, underside of the bag 300 may include a tiny zip on the pocket to pack the rain cover inside.

In various embodiments, an outer cover (for example, a back panel) of the bag 300 includes high-quality custom-molded foam, which makes it easy for the traveler to carry the bag 300 on the back.

In an exemplary embodiment, the interior of the bag 300 may include one or more of a soft-lined phone pocket, document sleeve, a passport pocket, penholders, three card sleeves, a key clip inside an internal zip pocket and a drink holder. The phone pocket may be soft-lined.

In various embodiments, the bag 300 may save time and money, may make travelers' life easier and may help them look good and professional. Further, the bag 300 may keep items safe and easily accessible via the top and the side. The first sleeve 102 and the second sleeve 104 may be made using neoprene. Therefore, an item may be suspended in a neoprene sleeve, such that if the bag 300 falls down the items do not hit the ground. The design of the bag makes it is easy to pack, carry and use it.

In various embodiments, the bag 300 may fit inside almost all current major airline carry-on dimensions. For example, the net weight of the bag may be 1.415 kg; the size of the bag may be 55 cm (length), 35 cm (width) and 20 cm (height) when fully packed. The depth of main compartment may be 20 cm. The weight of a carry-on rain cover may be 0.07 kg.

In various embodiments, the bag 300 may have an ergonomic design. For example, the bag may include a 4-point load balancing system and an adjustable chest strap.

Figure 5A:
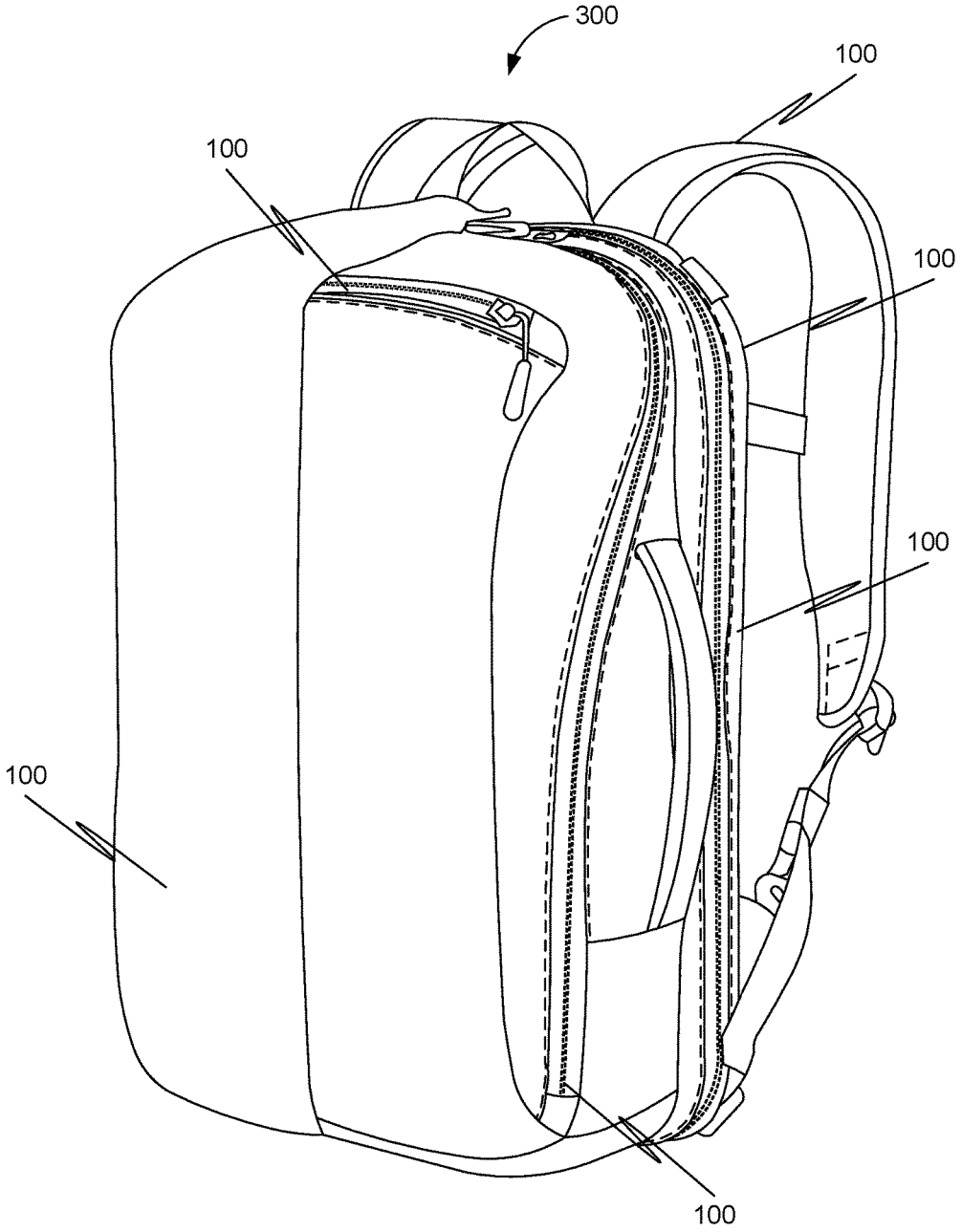
FIG. 5A illustrates yet another bag in closed position according to some embodiments.
Figure 5B:
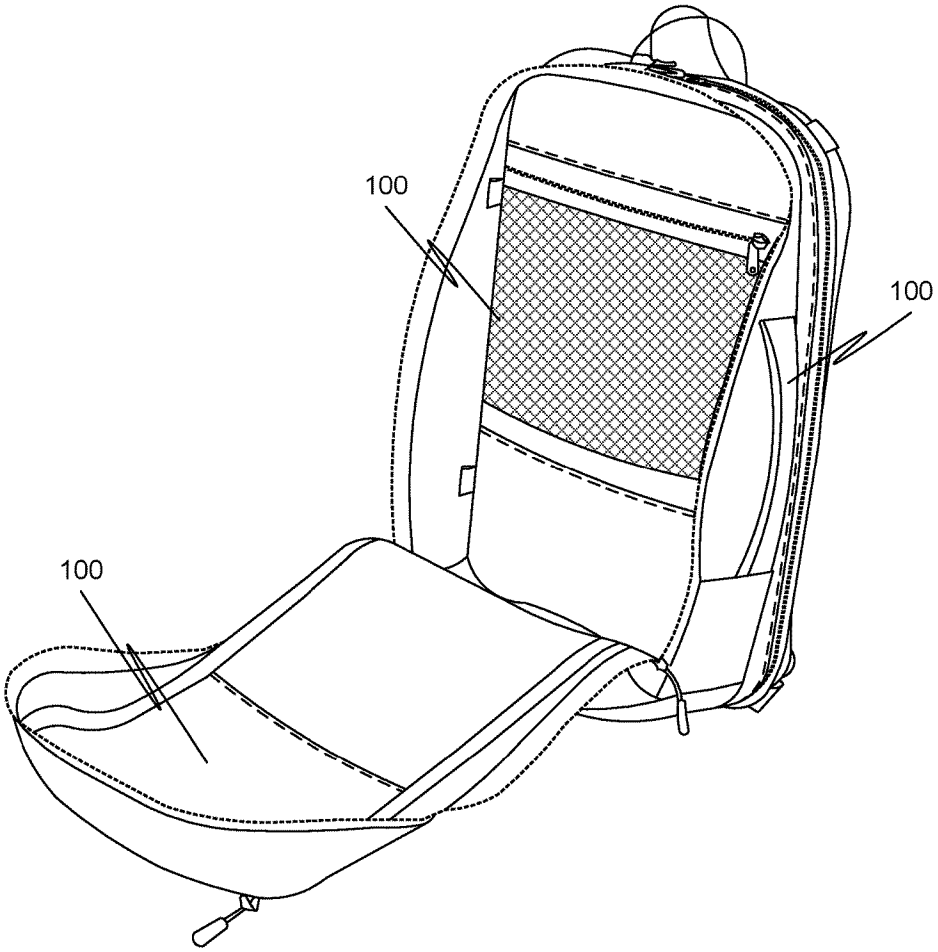
FIG. 5B illustrates yet another embodiment of the dual-access point system installed in a bag according to some embodiments.
Figure 6:
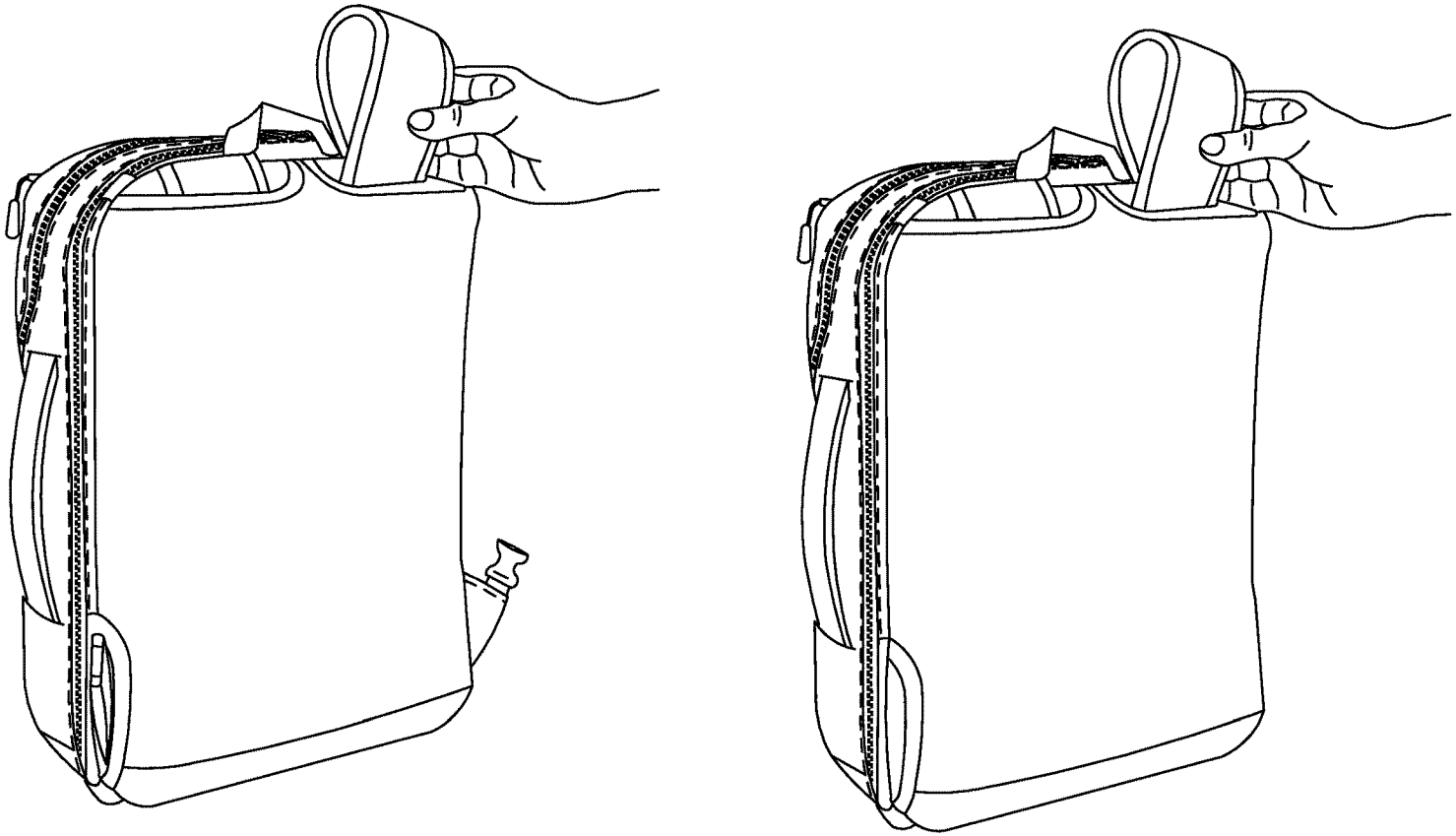
FIG. 6 illustrates a bag with hidden straps in closed position according to some embodiments.
Figure 7:
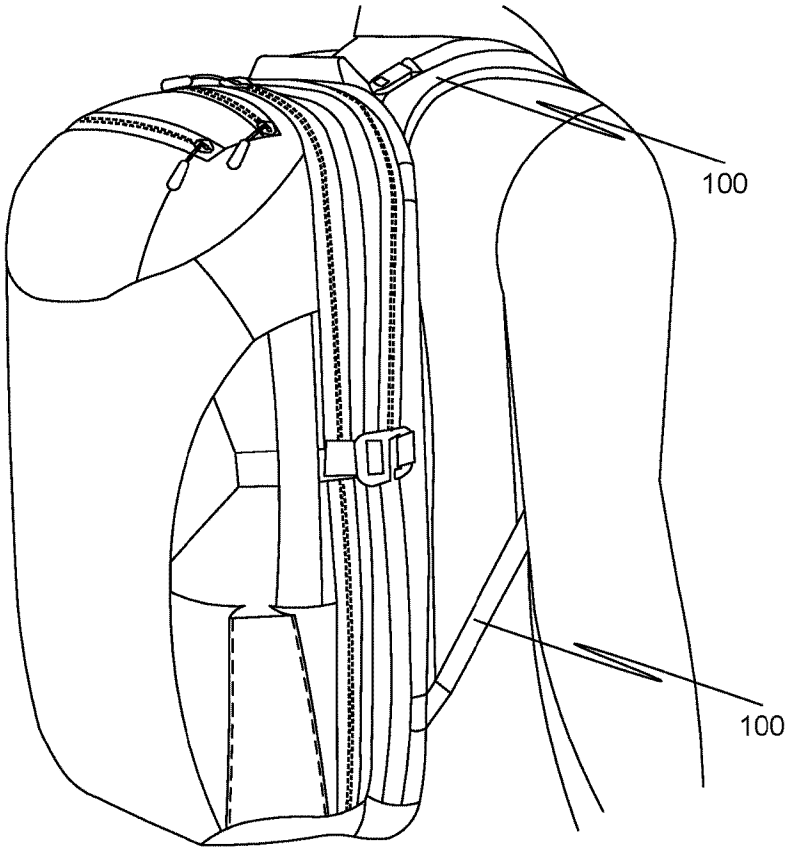
FIG. 7 illustrates the bag with adjustable straps in closed position according to some embodiments.
Figure 8:
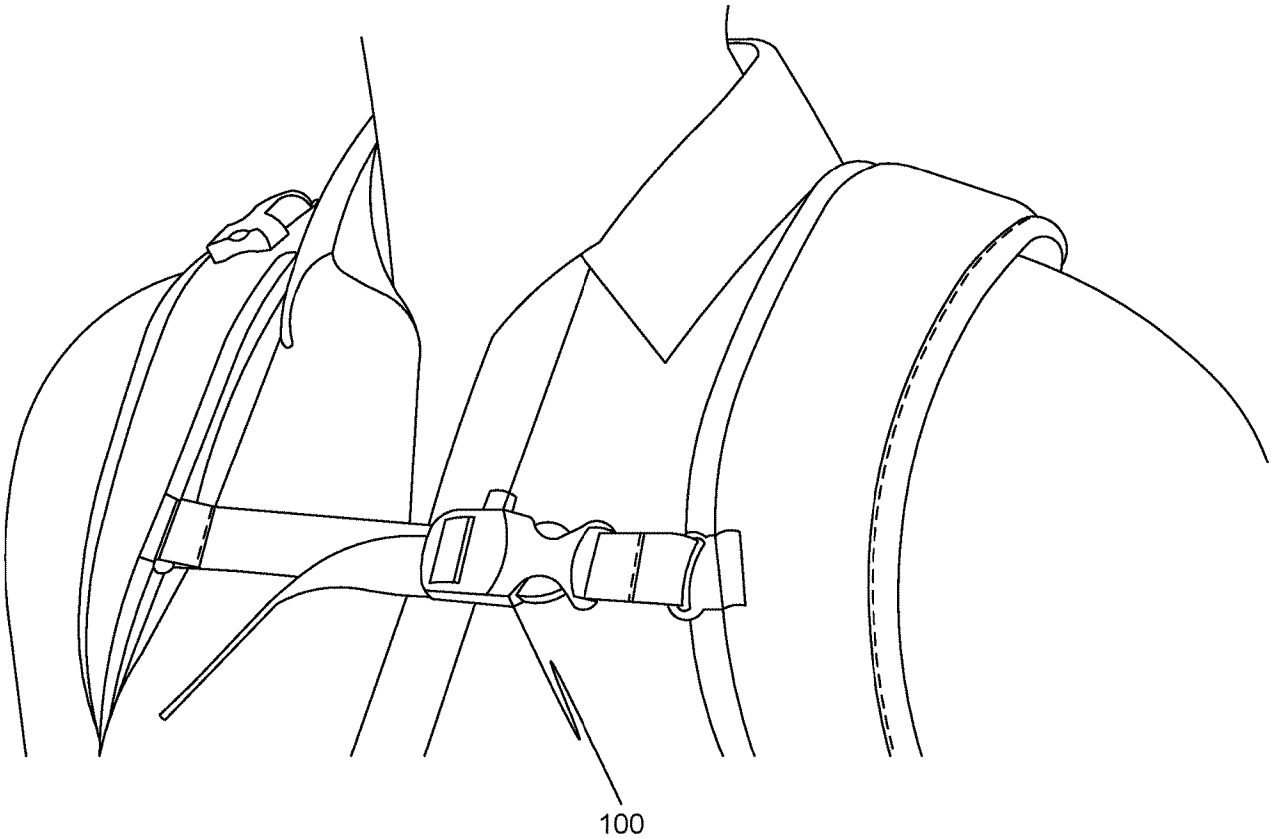
FIG. 8 illustrates the bag with a chest strap in closed position according to some embodiments.

FIG. 5A illustrates yet another bag in closed position according to some embodiments. FIG. 5B illustrates yet another embodiment of the dual-access point system installed in a bag according to some embodiments. FIG. 6 illustrates a bag with hidden straps in closed position according to some embodiments. FIG. 7 illustrates the bag with adjustable straps in closed position according to some embodiments. FIG. 8 illustrates the bag with a chest strap in closed position according to some embodiments.\

Embodiments of the present disclosure, for example, are described above with reference to block diagrams and/or operational illustrations of methods and apparatus, according to embodiments of the disclosure. The functions/acts noted in the blocks may occur out of the order illustrated or in various combinations. For example, two blocks shown in succession may in fact be executed substantially concurrently or the blocks may sometimes be executed in the reverse order, depending upon the functionality/acts involved.

The following is claimed:

1. A dual-access point system comprising:

a back cover;

a first sleeve attached to the back cover so as to create a first opening and a second opening in-between the first sleeve and the back cover;

wherein the first sleeve is attached by:

a first seam from a left side to a bottom side of the back cover, and a first corner seam from an upper right corner of the back cover;

a second sleeve attached to at least one of the back cover and the first sleeve so as to create a third opening and a fourth opening in-between the second sleeve and the first sleeve;

wherein the second sleeve is attached by:

a second seam from a left side to a bottom side of the back cover, and a second corner seam from an upper right corner of the back cover;

wherein the first corner seam and the second corner seam are connected to one another; and a first ladder mechanism configured to secure at least one of the first sleeve and the second sleeve against the back cover in a first axis traversing the first opening and the third opening; and a second ladder mechanism configured to secure at least one of the first sleeve and the second sleeve against the back cover in a second axis traversing the second opening and the fourth opening.

2. The system of claim 1, wherein the ladder mechanism is configured to apply and relieve compression from:

the first sleeve against the back cover, and the second sleeve against the first sleeve.

3. The system of claim 1, further comprising a first fastener configured to secure the first sleeve and the second sleeve in the first axis.

4. The system of claim 1, further comprising a second fastener configured to secure the first sleeve and the second sleeve in the second axis.

5. The system of claim 1, wherein the back cover is configured to be attached to a host bag.

6. The system of claim 5, wherein the back cover is configured to be detached from the host bag.

7. The system of claim 1, wherein the first sleeve is configured to store at least one larger item.

8. The system of claim 7, wherein the second sleeve is configured to store at least one smaller item.

9. The system of claim 1, wherein the first opening and the third opening are top openings.

10. The system of claim 1, wherein the second opening and the fourth opening are side openings.

11. A dual-access point system comprising: a back cover; a first sleeve attached the back cover so as to create a first opening and a second opening in-between the first sleeve and the back cover; wherein the first sleeve is attached by: a continuous edge seam running along a left side and a bottom side of the back cover, and a corner seam from an upper right corner of the back cover; a first fastener configured to secure the first sleeve against the back cover in a first axis traversing the first opening; and a second fastener configured to secure the first sleeve against the back cover in a second axis traversing the second opening.

12. The system of claim 11, wherein the back cover is configured to be attached to a host bag.

13. The system of claim 12, wherein the back cover is configured to be detached from the host bag.

14. The system of claim 11, wherein the first opening is a top opening.

15. The system of claim 11, wherein the second opening is a side opening.

* * * * *